US005511685A

United States Patent [19]

Nelson

[11] Patent Number: 5,511,685

[45] Date of Patent: Apr. 30, 1996

[54] MUG SIMULATING A HELMET AND HELMET WEARER

[75] Inventor: Richard A. Nelson, Cary, N.C.

[73] Assignee: Revell-Monogram, Inc., Morton Grove, Ill.

[21] Appl. No.: 317,761

[22] Filed: Oct. 4, 1994

[51] Int. Cl.[6] ..... B65D 65/00

[52] U.S. Cl. ..... 220/662; D7/514; D7/604; D7/606; D7/623

[58] Field of Search ..... 220/662; D7/604, D7/606, 613, 623, 514, 702

[56] References Cited

U.S. PATENT DOCUMENTS

| | | | |
|---|---|---|---|
| D. 218,349 | 8/1970 | Feeney | D7/604 |
| D. 232,011 | 7/1974 | Denton | D7/604 |
| D. 243,578 | 3/1977 | Danat | D7/5 |
| D. 250,444 | 12/1978 | Danat et al. | D7/5 |
| D. 289,598 | 5/1987 | Parmet | D7/606 |
| D. 314,492 | 2/1991 | Weller et al. | D7/623 |
| D. 337,242 | 7/1993 | Steinfels, III | D7/623 |
| 3,874,977 | 4/1975 | Pyles | D7/514 X |
| 4,789,073 | 12/1988 | Fine | 220/662 X |
| 5,351,851 | 10/1994 | Powell | 220/662 X |

*Primary Examiner*—Steven M. Pollard
*Attorney, Agent, or Firm*—Olive & Olive

[57] ABSTRACT

An improved beverage helmet mug which contains a window area, simulating the viewing window of a helmet. The mug has a body having a liquid-holding interior area and an exterior shape simulating a particular helmet style, of a particular helmet wearer, and has a convex front side having a window area in the shape of said viewing window. A section of a photographic image, showing the eyes and surrounding facial portion of said wearer and formed in the shape and size of said window area is affixed in the window area. Surface designs on the mug simulate exterior designs on the helmet. In addition, the mug of the present invention is constructed such that it may be used with a beverage container securely and releasably held therein, with beverage contained directly by the mug, or as a collector's item.

9 Claims, 4 Drawing Sheets

MUG SIMULATING A HELMET AND HELMET WEARER

BACKGROUND OF THE INVENTION

1. Field of the Invention

This invention relates to drinking mugs and particularly to a drinking mug that simulates a sports helmet with the image of a portion of the face of the helmet wearer on one side of the mug in a designated window area.

2. Description of the Related Art

Drinking mugs come in all different shapes, colors and sizes. Many mugs are designed to promote specific events. Promotional mugs typically include logos, text, and/or images that relate to a particular event, person or organization. For example, drinking cups used to serve spectators at sports events typically have the home team's logo and other related text and imagery printed on the exterior surface of the cups. More elaborate mugs are typically sold at souvenir shops. An example of a more elaborate mug is a football helmet beverage holder as shown in U.S. Pat. No. Des. 337,242 to Victor E. Steinfels, IL. This beverage holder has a simulated grid protective mask portion attached to the body of the mug that is used as the mug handle. Other helmet-like mugs are disclosed in U.S. Pat. Nos. Des. 314,492 of Weller et al. and Des. 243,578 of Danat. These mugs do not include a simulated portion that supports and displays the image of the face of the helmet wearer, and therefore these inventions do not simulate a particular helmet and helmet wearer.

Therefore, it is an object of the present invention to produce a beverage mug that simulates a helmet, and the particular helmet wearer.

A further object of the present invention, is to construct a mug adapted to hold liquid beverage and to hold a beverage container.

Other objects and advantages will be more fully apparent from the following disclosure and appended claims.

SUMMARY OF THE INVENTION

The improved beverage helmet mug of the present invention contains a specific window area, simulating the viewing window of a helmet, which is adapted to hold the image of the helmet wearer therein. The image of the helmet wearer adds significant realism to the mug. In addition, the mug of the present invention is constructed such that it may be used in two configurations. The first configuration is with a beverage container securely and releasably held therein. The second configuration is with beverage contained directly by the mug of the present invention. In addition, the mug of the invention may be used to hold such items as flowers or pencils, or as an ornamental container and collector's item particularly when made to simulate celebrities and their helmets.

Other aspects and features of the invention will be more fully apparent from the following disclosure and appended claims.

DETAILED DESCRIPTION OF THE INVENTION AND PREFERRED EMBODIMENTS THEREOF

The mug 20 of the invention generally comprises a mug body 22 and a handle 24. Mug body 22 has an overall exterior shape simulating a particular helmet. In a preferred embodiment mug body 22 simulates a particular racing helmet. Although there are substantial variations in helmet shapes, most helmets have a central frontal convex area where the helmet extends outward to protect the face. The front side of many helmets also has a transparent or open viewing window to allow the wearer to see out of the helmet. This viewing window is generally part of the upper portion of the convex area where the helmet slopes outward and downward.

Figure 1:
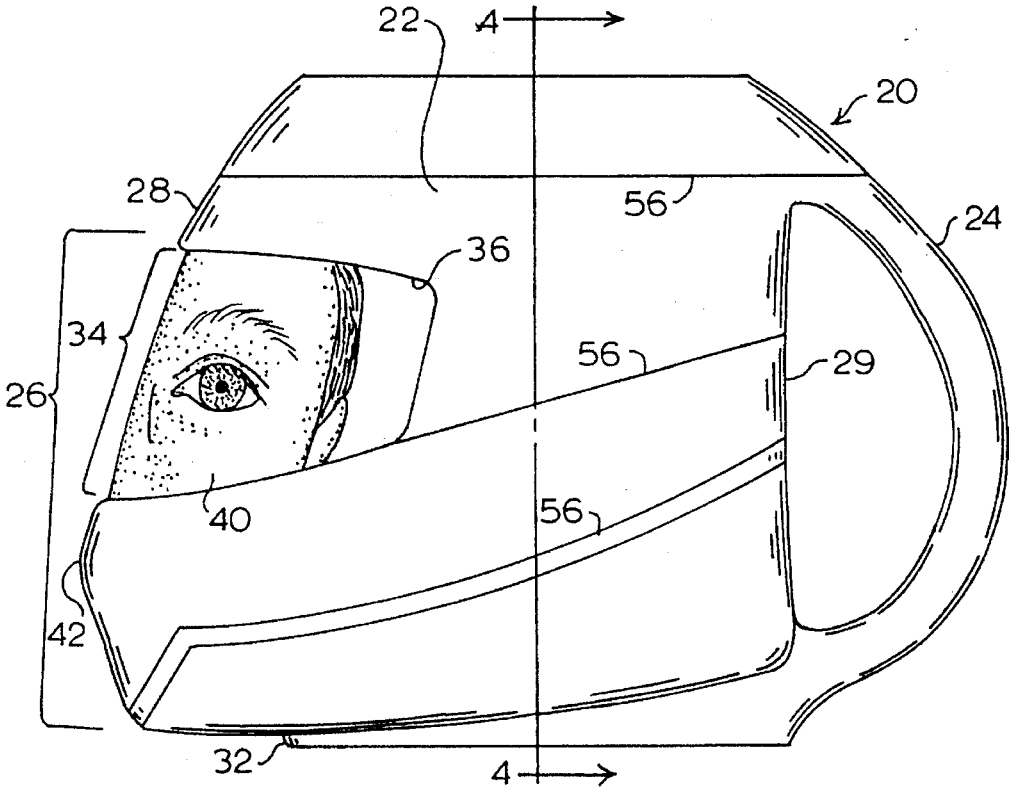
FIG. 1 is an elevational side view of a mug according to the invention.
Figure 2:
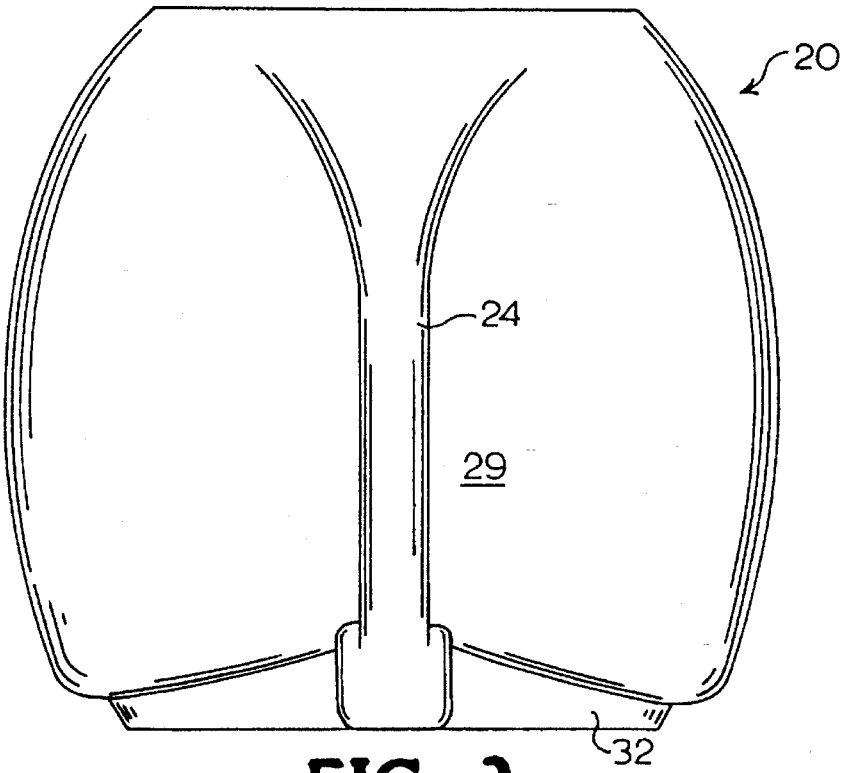
FIG. 2 is a rear elevational view of the mug of FIG. 1 without the rim.
Figure 4:
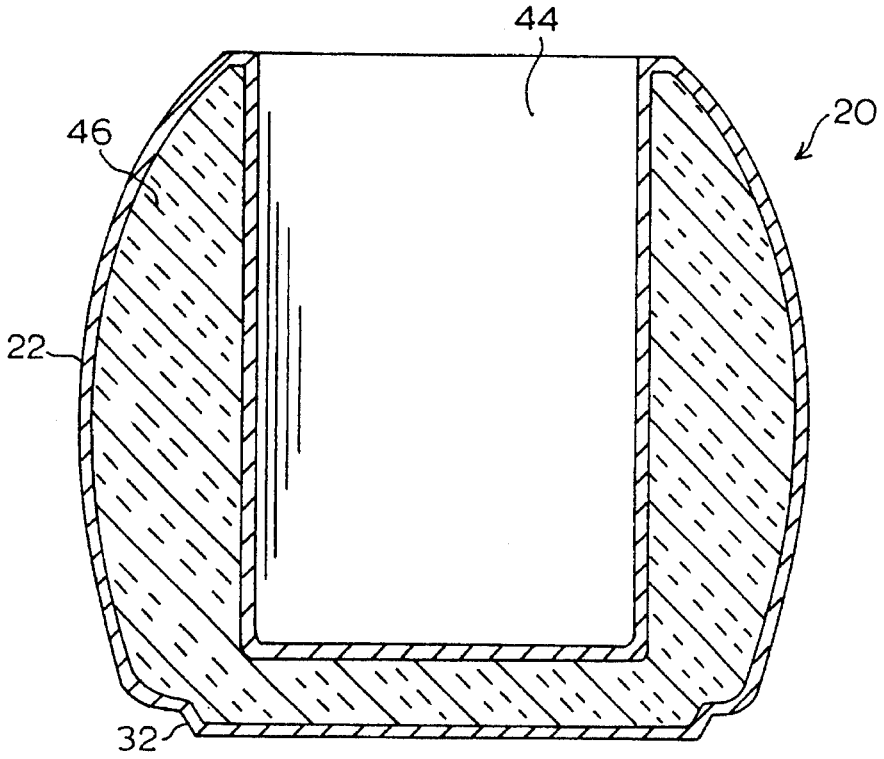
FIG. 4 is a cross-sectional view of the mug of FIG. 1 without the rim along line 4—4.
Figure 8:
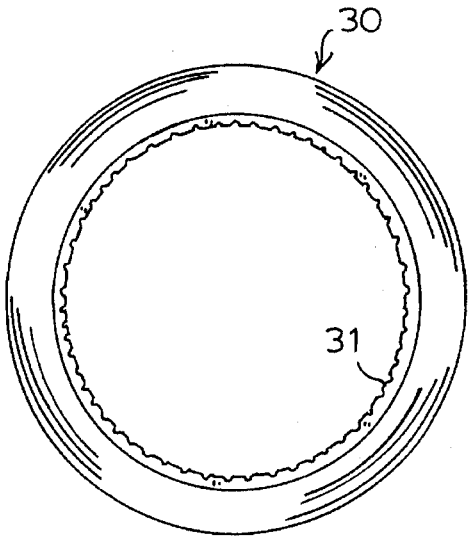
FIG. 8 is an upper plan view of the rim of the mug of the invention.
Figure 7:
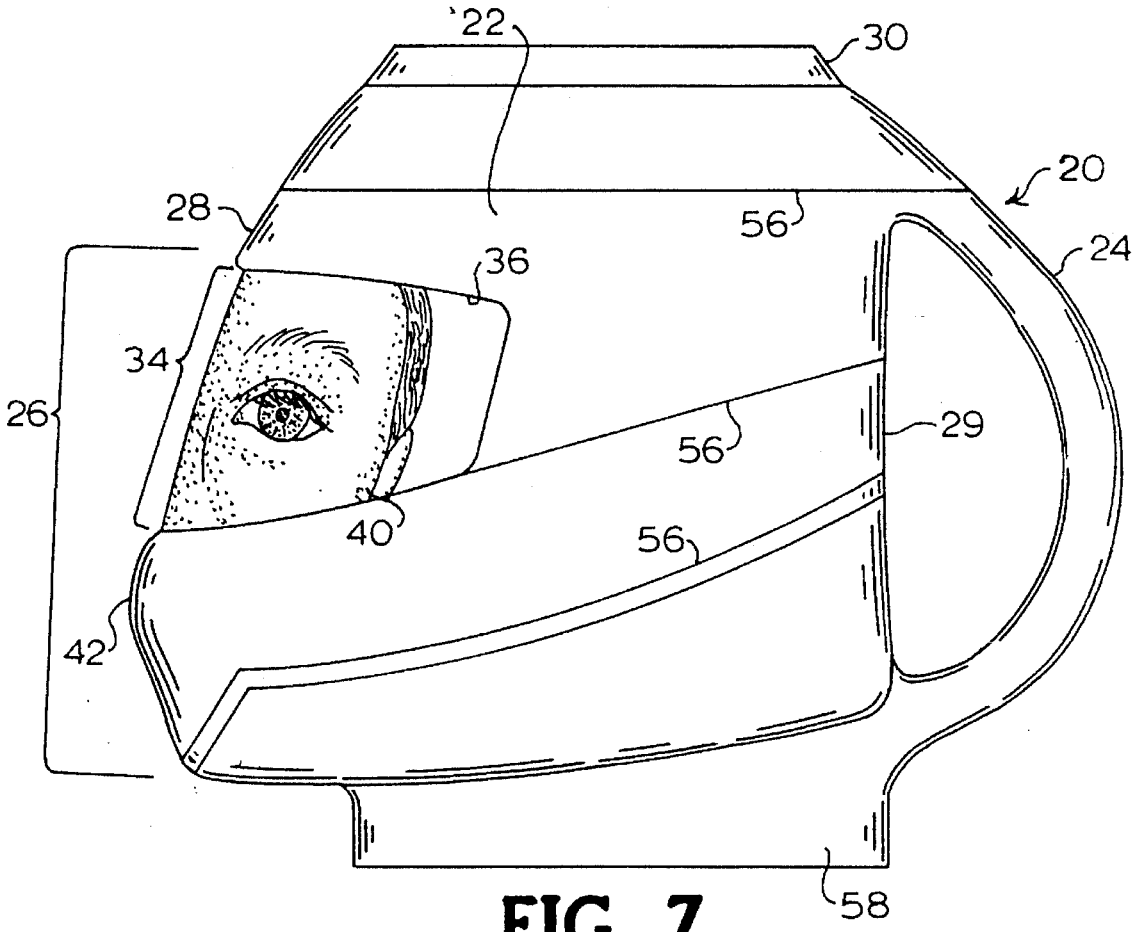
FIG. 7 is a side elevational view of an embodiment of the mug of the invention having an extended pedestal base.

As illustrated in FIGS. 1 and 7, each mug 20 of the invention simulates a particular helmet design, and has a central convex area 26 on front side 28 opposite mug handle 24. A central convex area 26 extends between an upper rim 30, shown in FIGS. 7 and 8, which is preferably made as a separate piece, and a lower base portion 32, so that the overall shape of mug 20 is that of the particular style of helmet. As shown in FIGS. 2 and 4, the height of base portion 32 may vary due to the shape of the lower edge of mug body 22, which may, for example, be curved to further aid in the simulation of a particular helmet.

Where the viewing window of the helmet would be, mug 20 has a specific, designated window area 34 having the same shape as the particular helmet's viewing window. Thus, mugs simulating different actual helmets with differently shaped windows have correspondingly differently shaped window areas. Typical viewing window shapes include shapes similar to goggles which have an upward bend in the lower central edge above the nose, generally rectangular shapes of various sizes rounded to fit the curve of the helmet, other shapes in which the main features include generally vertical side edges of the window and (usually) somewhat rounded lower and upper edges of the window, and variations on these shapes (possible rounding or squaring of corners, modern-looking angles of edges, and the like).

Although not necessary for the invention, to enhance the appearance of a real helmet, the edge 36 of window area 34 is preferably recessed about 1/16 inch from the adjacent portion of mug 20 as shown in FIG. 1 and 7, and all points on the surface of the remaining portion of window area 34 as covered by the photograph are preferably recessed about 1/16 inch inward from where the outer surface of mug 20 would be if the mug's outer surface did not have a window area 34 but extended in an unbroken plane from above window area 34 to below window area 34 in that location on the mug surface. This unbroken plane, and thus the surface shape of window area 34 is preferably generally either flat or slightly rounded in the same manner as the portions of mug 20 adjacent window area 34. Where the window area 34 is not recessed, the viewing area on mug 20 is defined by the placement of the photograph, as well as by the placement of decorative features 56.

Figure 9:
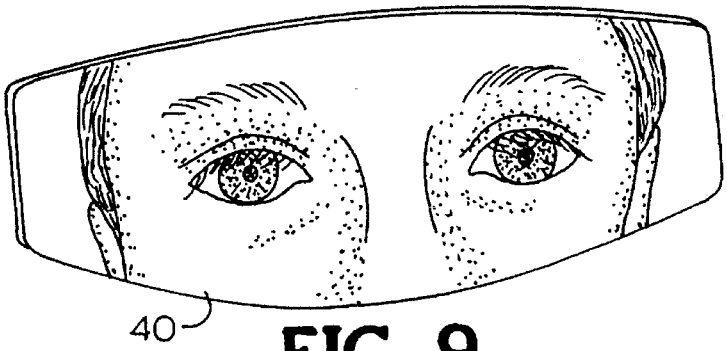
FIG. 9 is a perspective view of a section of a photograph as used on the mug of FIG. 1.

As stated above, mug 20 of the invention is preferably designed to simulate the shape of the appearance of a particular helmet, and of a particular wearer of the helmet, e.g., a particular race-car celebrity in the preferred embodiment. Therefore, as illustrated in FIG. 9, the invention also comprises a section 40 of a photograph of the particular race-car celebrity's face so that the portions of the face utilized represent those which would show in the viewing window of the actual helmet, scaled down to the size of mug 20. Thus, section 40 of a facial photograph of the wearer showing the eyes and surrounding portions of the face, and being in the size and shape of window area 34 is affixed to mug 20 in window area 34 so that mug 20 has the appearance of a helmet with the face of the particular wearer visible in window area 34 as it would be in the viewing window of the actual helmet (see FIGS. 1, 3 and 7).

The photograph is preferably applied to vinyl or other waterproof material, or is otherwise produced in a waterproof medium affixable to mug 20, as is known in the art, so that mug 20 and photograph will be functionally durable. The photograph copy of the face portion may be applied to vinyl or other waterproof material by any means known in the art so that the final result actually accurately portrays a real face, for example with circular screen printing, which is a silk-screen process which may be done by hand, or be semi-automatic or totally automated. Suitable techniques for application of the photograph to the material include offset press printing, gravure processes, screen printing, heat transfer printing, and electronic printing systems. See *A Graphic Arts Production Handbook,* International Paper Co., 1989 edition, pages 128–140.

In the most preferred embodiment, the photograph is produced using a recently developed 4-color process of Indigo America, Inc. (Woburn, Mass.) called "digital offset color" or "E-Print" which combines the advantages of offset printing (liquid ink, durability) with those of digital imaging technology.

Above and/or below window area 34, mug 20 preferably has ridges or other protrusions or indentations if the actual simulated helmet has guards or other structural features above and/or below the viewing window, such as the shape of protruding helmet visor, face guard bar or other structural feature of the helmet. Mug 20 shown in FIGS. 1–5has an outwardly rounded area 42 beneath window area 34 and simulates a helmet with a jutting out portion below the window, in the area of the wearer's chin.

Figure 5:
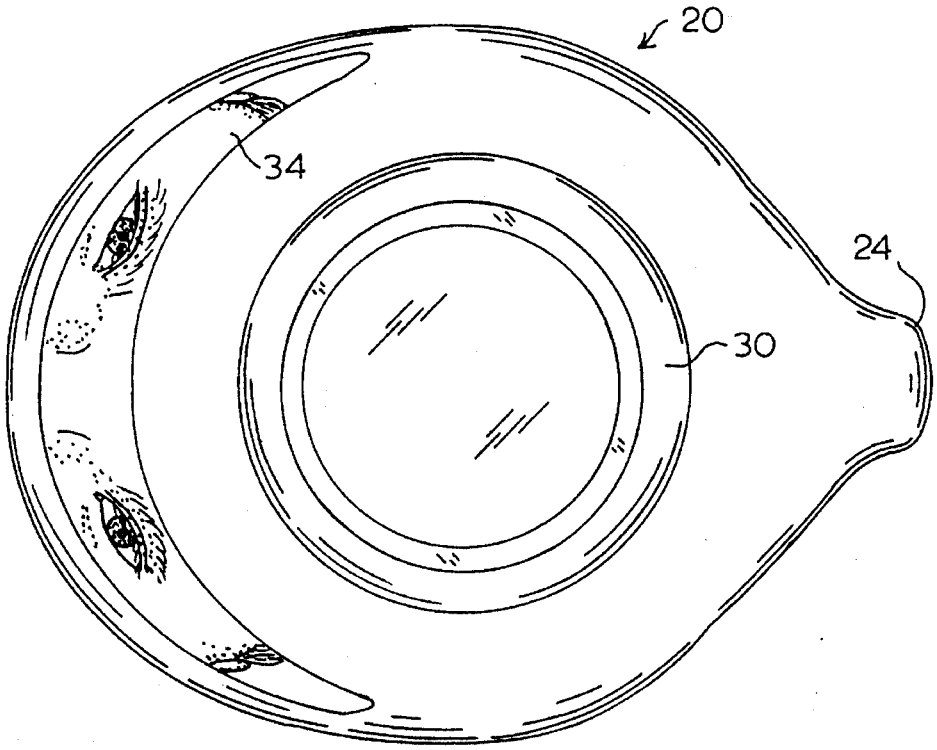
FIG. 5 is an upper perspective view of the mug of FIG. 1.

As illustrated in FIGS. 4 and 5, mug body 22 has a hollow liquid-holding interior area 44 to allow it to be used for holding beverages (either directly, for example in the insert cup 48 discussed below, or in a standard beverage can placed in interior area 44). Preferably interior area 44 is surrounded by insulating material 46, which is preferably made of polypropylene and is added during the manufacturing process to fill part or all of the inner space around interior area 44, depending upon the degree of insulation required, and the cost factors. Such insulation is in itself waterproof, and may therefore surround interior area 44 directly. Interior area 44 is preferably of a size and shape so that a user may place either a standard beverage can, or an insert cup 48 (described below) in interior area 44.

The upper edge of mug body 22 surrounding interior area 44 is preferably capped with an upper rim 30 which preferably has a tapered exterior shape so that the exterior of mug 20 and attached rim are together generally smooth. Rim 30 is preferably formed as a separate piece and has small inward-facing teeth 31 which "grab" the mug and form a permanent bond, leaving a finished edge for the insert cup or beverage can to slide in and out of freely.

Figure 6:
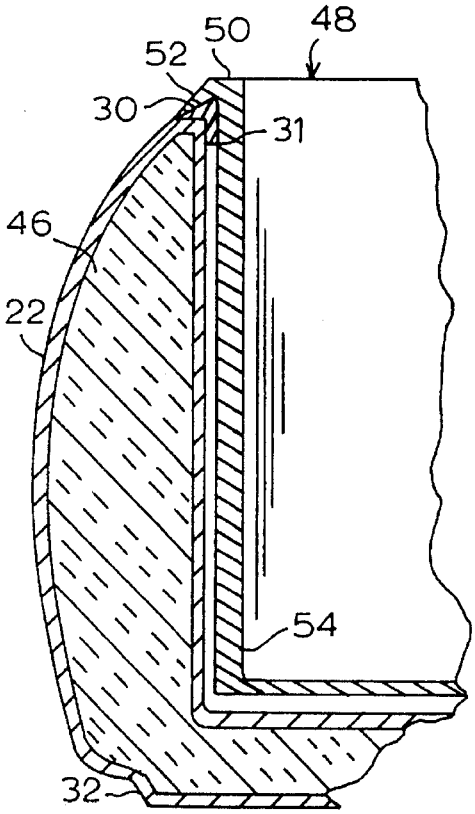
FIG. 6 is a partial cross-sectional view of an insert cup in the mug body of the invention.

An insert cup 48 similar to those known in the art as shown in partial cross-section in FIG. 6 is preferably provided with mug 20. Insert cup 48 has an upward facing lip 50 surrounded at its lower edge by a lower flange 52. A beverage containing portion 54 of insert cup 48 is of a size to fit firmly in hollow interior area 44 so that insert cup 48 does not fall out when mug 20 is tipped up to drink a beverage out of the cup. As also shown in FIG. 6, the shape of the flange also enables insert cup 48 to fit firmly over rim 30 of mug 20.

As shown in FIG. 1, the preferred handle 24 of mug 20 of the invention extends from the top to the bottom of mug body 22 to provide a streamlined appearance to rear side 29 of mug 20 and to maximize the ease of holding mug 20. Other handle appearances and styles may be used, but it is important that the handle style not detract from the overall helmet appearance of mug 20.

Figure 3:
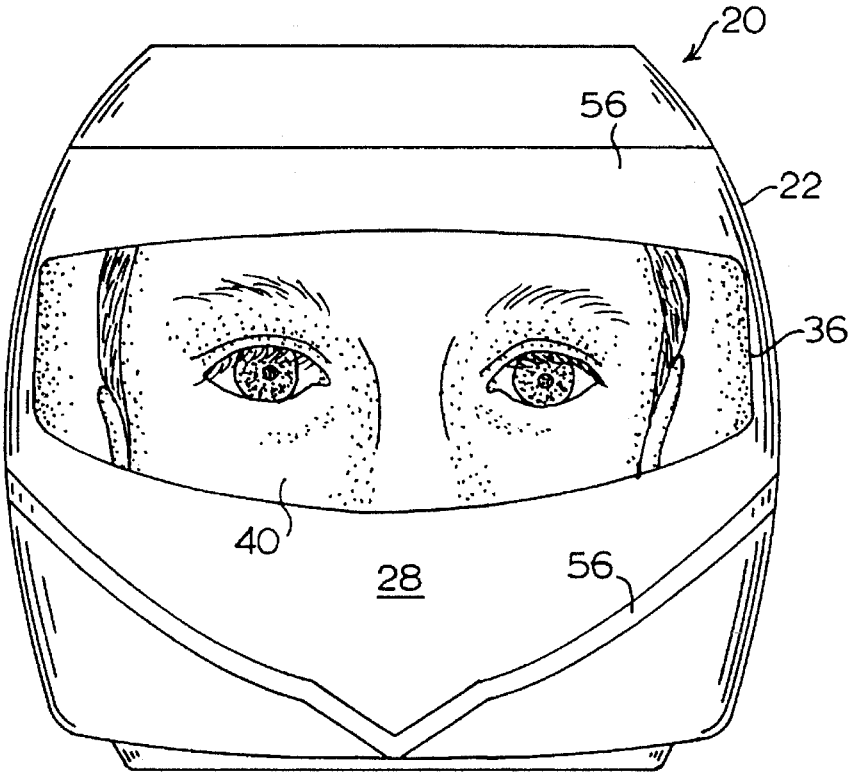
FIG. 3 is a front elevational view of the mug of FIG. 1.

The construction of mug 20 of the invention to resemble the helmet of a particular wearer (celebrity) also includes addition to mug 20 of decorative decals, advertising logos, names, and other trademark features, and designs such as stripes, areas of particular colors and shapes, distinctive patterns, and other external decorative features 56 so that these decorative features 56 are also preferably recognizable for identification of the chosen celebrity whose photograph appears in the window area but appropriately reduced in size, compared to those used on the particular actual helmet (see FIGS. 1, 3 and 7). Not shown specifically in the figures but clearly part of the decorative features 56 included within the scope of the invention are particular advertising copy, words, numbers, and the like, primarily used to identify the advertisers and supporters of the celebrity.

These decorative features 56 may be applied to mug 20 by the same means as the corresponding decorative features are applied to the actual helmet, or by any means known in the art which results in the same overall appearance as the helmet decorations. Thus, similar printing processes may be used to print decals and the like for placement on the remaining portions of the helmet as are used for the wearer's photograph. A preferred process for application of the decorative features 56 is by the application of decals, for example, adhesive-backed vinyl labels or labels having a water-activated glue backing. Alternatively, the decorative features may be applied by "tampo" or "pad" printing as is used on the helmets themselves in which a machine simply stamps the paint or any applicable medium on the helmet. Other processes, such as circular screen printing, may be used to print directly on the rounded mug surface.

Although any material that is formable into the shape of the invention, durable, reusable, and waterproof may be used to make the mugs, such as various plastics, styrene, and polypropylene materials, the preferred components of the invention are acrylonitrile butadiene styrene (ABS) for mug body 22, polypropylene for rim 30 and insert cup 48, and polystyrene for insulating material 46. These various components of the invention are preferably formed of the selected material into the desired shape by means known in the art, preferably using a mold form.

Mug 20 of the invention is preferably any standard mug size or slightly larger if desired, and may be made any size so long as the relative proportions simulate the actual helmet and wearer.

Although mug 20 of the invention is preferably shaped like a particular race-car driver's helmet, it is within the scope of the invention to have mugs shaped like other sports helmets with a photograph of the eye area of the particular athlete placed in a window area 34 simulating the viewing window or opening of the particular helmet, and having the particular design, colors, and player or team identifier or indicia on the remaining areas of mug 20 to identify mug 20 as a whole as being associated with a particular wearer, such as a celebrity sports star.

Mug 20 of the invention may optionally include an extended pedestal base 58 below the helmet-shaped mug body 22 as shown in FIG. 7.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A mug, comprising:

(a) a body having a liquid-holding interior area and an exterior shape simulating a particular helmet style of a particular helmet wearer, said helmet having a viewing window and exterior designs, said exterior shape comprising a surface having a convex front side and a rear side, said convex front side having a window area in the shape of said viewing window;

(b) a section of a photographic image, showing the eyes and surrounding facial portion of said wearer, said section formed in the shape and size of said window area and affixed to said window area;

(c) a handle on the rear side; and (d) surface designs simulating said exterior designs.

2. The mug of claim 1, wherein the window area is recessed about 1/16 inch, and is generally rectangular in shape.

3. The mug of claim 1, wherein the section is printed on vinyl.

4. The mug of claim 1, wherein the mug is made of acrylonitrile butadiene styrene.

5. The mug of claim 1, further comprising a rim attached to the mug surrounding the top of said interior area.

6. The mug of claim 5, further comprising a cup insert having a flange, wherein said flange fits over said rim and said cup insert fits in said interior area.

7. The mug of claim 1, further comprising an insulated area surrounding said interior area.

8. The mug of claim 1, further comprising a pedestal base below the mug body.

9. The mug of claim 1, wherein said window area is recessed.

* * * * *